US008431295B2

(12) United States Patent
Yasukawa et al.

(10) Patent No.: US 8,431,295 B2
(45) **Date of Patent: *Apr. 30, 2013**

(54) TONER FOR DEVELOPING ELECTROSTATIC IMAGE, FULL COLOR TONER KIT, AND IMAGE FORMATION METHOD

(75) Inventors: Hiroyuki Yasukawa, Tokyo (JP); Hiroshi Yamazaki, Tokyo (JP); Kaori Soeda, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 269 days.

This patent is subject to a terminal disclaimer.

(21) Appl. No.: 12/829,982

(22) Filed: Jul. 2, 2010

(65) Prior Publication Data

US 2011/0008720 A1 Jan. 13, 2011

(30) Foreign Application Priority Data

Jul. 13, 2009 (JP) ..... 2009-164547

(51) Int. Cl.
*G03G 9/00* (2006.01)

(52) U.S. Cl.
USPC ..... 430/108.21; 430/107.1; 430/108.1; 430/123.57

(58) Field of Classification Search ..... 430/107.1, 430/108.1, 108.21, 123.57
See application file for complete search history.

(56) References Cited

U.S. PATENT DOCUMENTS

| | | | | |
|---|---|---|---|---|
| 7,422,834 | B2 * | 9/2008 | Akiyama et al. | 430/108.23 |
| 2009/0239168 | A1 * | 9/2009 | Kouyama et al. | 430/107.1 |

FOREIGN PATENT DOCUMENTS

| | | |
|---|---|---|
| JP | 2005157314 | 6/2005 |
| JP | 2006154363 | 6/2006 |
| JP | 2006267741 | 10/2006 |
| JP | 2007140076 | 6/2007 |
| JP | 2007286148 | 11/2007 |

* cited by examiner

*Primary Examiner* — Stewart Fraser
(74) *Attorney, Agent, or Firm* — Lucas & Mercanti, LLP

(57) ABSTRACT

Disclosed are a toner for developing an electrostatic image, a full color toner kit and an image formation method, the toner containing at least a resin and a colorant, wherein the colorant comprises a quinacridone pigment having a number average primary particle size of from 30 to 150 nm and having a ratio of a major axis direction length to a minor axis direction length of from 1.0 to 2.0 and Pigment Red 238.

16 Claims, 1 Drawing Sheet

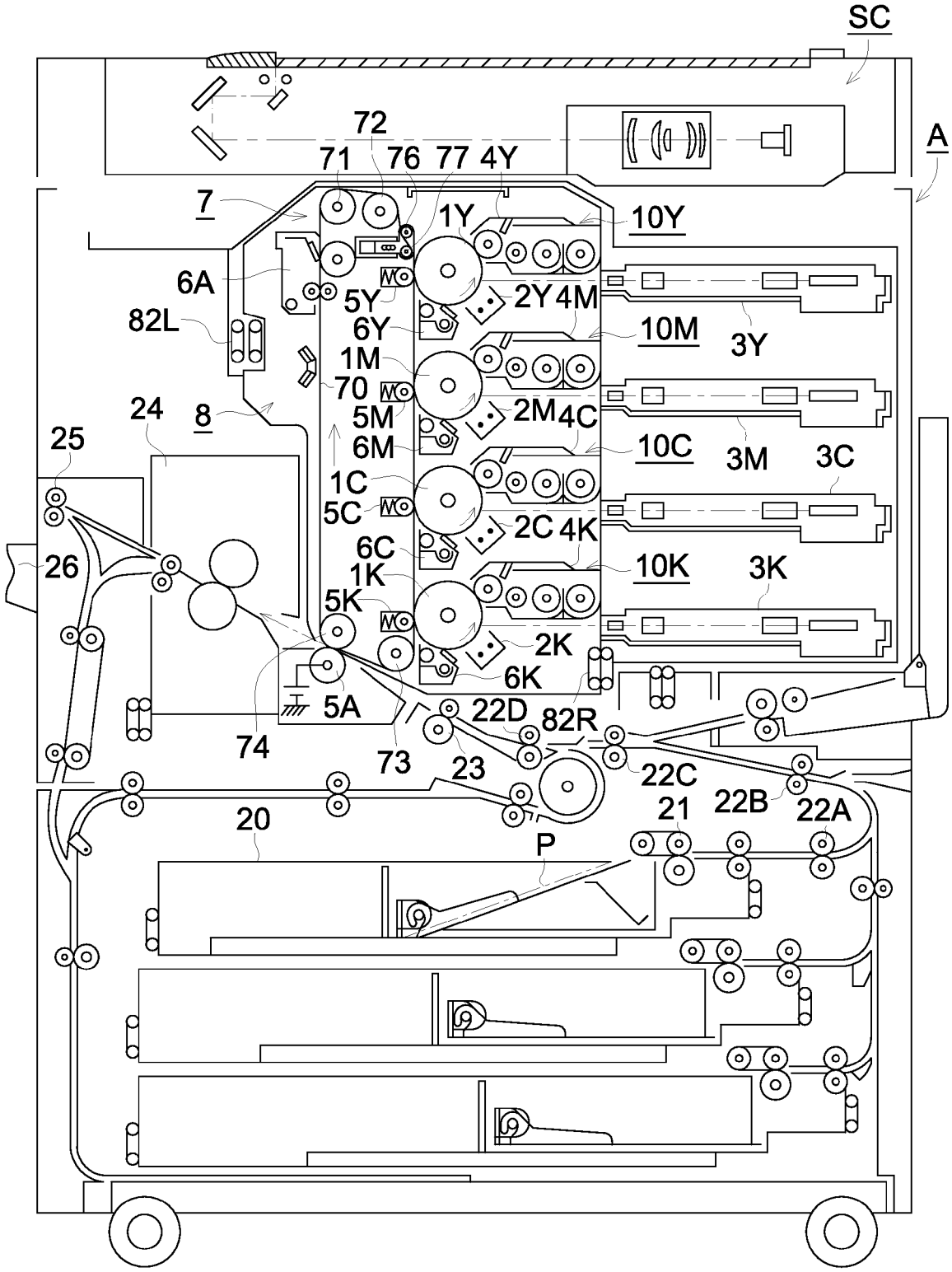
SC
A
72
71
76
77
4Y
7
1Y
10Y
6A
5Y
2Y
4M
82L
6Y
10M
3Y
1M
70
5M
2M
4C
24
8
25
6M
10C
3M
3C
1C
5C
2C
4K
6C
26
1K
10K
3K
5K
2K
6K
5A
22D
82R
74
73
23
22C
21
22B
22A
20
P

TONER FOR DEVELOPING ELECTROSTATIC IMAGE, FULL COLOR TONER KIT, AND IMAGE FORMATION METHOD

This application is based on Japanese Patent Application No. 2009-164547, filed on Jul. 13, 2009 in Japanese Patent Office, the entire content of which is hereby incorporated by reference.

FIELD OF THE INVENTION

The present invention relates to a toner for developing an electrostatic image for use in electrophotographic image formation, and particularly to a toner for developing an electrostatic image comprising, as a colorant, quinacridone pigment having a specific particle size and a specific shape and Pigment Red 238.

BACKGROUND OF THE INVENTION

Recently, electrophotographic image formation using an electrostatic image developing toner (hereinafter also denoted simply as toner) has been applicable to full-color prints as well as monochromatic prints as typified in conventional documentation. As such a full-color image forming apparatus can make printed sheets by the number as required on demand without printing plates, which are required in conventional printing, it has been employed mainly in a short-run printing field in which a small number of prints are often ordered (see for example, Japanese Patent O.P.I. Publication No. 2005-157314).

When making a full-color print used for catalogues or printed advertisements by using a toner, the toner is required to provide color reproduction so as to be faithful to an original image. In full-color image formation, yellow, magenta and cyan toner images are superimposed to reproduce a targeted color image and a color toner as a base is required to have superior color reproducibility in obtaining faithful color reproduction. Particularly in the catalogues or printed advertisements including a portrait image, a high chroma toner, which is capable of reproducing a color tone such as flesh tone faithfully, is required.

Particularly in recent years, opportunities have been increased which outputs a graphic image formed on a display employing a computer. The color gamut of an image formed according to a conventional color printing method or a conventional color electro-photographic method is far narrower than that of an image formed on a display, and therefore, it is difficult to output an image on the display on a paper to reproduce the color tone of the image as it is. Particularly, reproduction of a so-called secondary color, which is derived from superposition of the color toners, is difficult. In view of the above, study to increase the color gamut of the toner has been made in order to output on a paper an image with color gamut close to that of an image on a display.

Accordingly, study on various colorants has been made in order to achieve increased color gamut or enhanced color reproducibility of color toners. A colorant for a magenta color toner has been studied. As one of typical examples for a magenta toner, there is quinacridone pigment. A toner using quinacridone pigment is generally used, since it exhibits superior light resistance and has an appropriate color tone as a magenta color. However, the toner using quinacridone pigment, when used in combination with other color toners, is likely to produce color contamination, and is difficult to obtain a satisfactory color tone when a high chroma image on a display or computer graphics are output in which high requirements for color tone are made.

Attempts have been made in which quinacridone pigment is not used alone, but used in combination with a dye, whereby chroma is improved (see Japanese Patent O.P.I. Publication No. 2007-286148). Further, attempts have been made in which quinacridone pigment is used in combination with other pigments such as naphthol pigment (see Japanese Patent O.P.I. Publication No. 2006-267741), anthraquinone pigment (see Japanese Patent O.P.I. Publication No. 2006-154363) or a mixture of anthraquinone pigment and azo pigment (see Japanese Patent O.P.I. Publication No. 2007-140076).

However, these techniques are difficult to obtain high light resistance which quinacridone pigment inherently has or to stably maintain color tone for a long term. The toner employing quinacridone pigment as a colorant has problems in that it is difficult to reproduce the color tone of an image on the display as it is, and to obtain an image with high chroma and high light resistance maintained for a long time.

SUMMARY OF THE INVENTION

An object of the invention is to provide a toner for developing an electrostatic image, which forms a full color image having high chroma and bright color tone, without color contamination, and which has excellent light resistance. Another object of the invention is to provide a toner for developing an electrostatic image capable of fitting its hue angle to color reproduction of a photographic image and of forming a secondary image with high chroma.

The toner for developing an electrostatic image of the invention (hereinafter also referred to as the toner of the invention) contains at least a resin and a colorant, wherein the colorant comprises quinacridone pigment (hereinafter also referred to as the quinacridone pigment in the invention) having a number average primary particle size of from 30 to 150 nm and having a ratio of a major axis direction length to a minor axis direction length of from 1.0 to 2.0 and Pigment Red 238.

BRIEF EXPLANATION OF THE DRAWING

FIG. 1 is a schematic view of one example of a tandem full color image formation apparatus capable of forming an image employing a two-component developer.

DETAILED DESCRIPTION OF THE INVENTION

The above object of the invention can be attained by any one of the following constitutions.

1. A toner for developing an electrostatic image, the toner containing at least a resin and a colorant, wherein the colorant comprises a quinacridone pigment having a number average primary particle size of from 30 to 150 nm and having a ratio of a major axis direction length to a minor axis direction length of from 1.0 to 2.0 and Pigment Red 238.

2. The toner for developing an electrostatic image of item 1 above, wherein the quinacridone pigment is a dimethylquinacridone pigment, a dichloroquinacridone pigment or an unsubstituted quinacridone pigment.

3. The toner for developing an electrostatic image of item 2 above, wherein the quinacridone pigment is a dimethylquinacridone pigment.

4. The toner for developing an electrostatic image of item 3 above, wherein the dimethylquinacridone pigment is C.I. Pigment Red 122.

5. The toner for developing an electrostatic image of item 4 above, wherein the C.I. Pigment Red 122 has a number average primary particle size of from 50 to 100 nm and a specific surface area of from 85 to 95 $m^2/g$.

6. The toner for developing an electrostatic image of item 1 above, wherein the Pigment Red 238 has a number average primary particle size of from 10 to 200 nm.

7. The toner for developing an electrostatic image of item 1 above, wherein the total content of the quinacridone pigment and Pigment Red 238 in the toner is from 1 to 10% by weight.

8. The toner for developing an electrostatic image of item 7 above, wherein the content ratio (by weight) of the quinacridone pigment to the Pigment Red 238 in the toner is from 10:90 to 90:10.

9. The toner for developing an electrostatic image of item 8 above, wherein the content ratio (by weight) of the quinacridone pigment to the Pigment Red 238 in the toner is from 30:70 to 70:30.

10. The toner for developing an electrostatic image of item 1 above, wherein the resin is a polymer having in the side chain a carboxyl group, a sulfonic acid group or a phosphoric acid group.

11. The toner for developing an electrostatic image of item 1 above, wherein the content of the resin in the toner is from 65 to 98% by weight.

12. The toner for developing an electrostatic image of item 1 above, wherein the toner has a volume based median size of from 3 to 8 μm.

13. The toner for developing an electrostatic image of item 1 above, wherein the toner has a coefficient of variation of from 2 to 21% in the volume based particle size distribution.

14. The toner for developing an electrostatic image of item 1 above, wherein the toner has a softening point (Tsp) of from 70 to 110° C.

15. A full color toner kit comprised of at least four kinds of toners, the four kinds of toners comprising a yellow toner containing at least a yellow colorant and a resin, a magenta toner containing at least a magenta colorant and a resin, a cyan toner containing at least a cyan colorant and a resin, and a black toner containing at least a black colorant and a resin, wherein the magenta colorant comprises a quinacridone pigment having a number average primary particle size of from 30 to 150 nm and having a ratio of a major axis direction length to a minor axis direction length of from 1.0 to 2.0 and Pigment Red 238.

16. An image formation method comprising the step of developing an electrostatic image employing at least four kinds of toners to form an image, the four kinds of toners comprising a yellow toner containing at least a yellow colorant and a resin, a magenta toner containing at least a magenta colorant and a resin, a cyan toner containing at least a cyan colorant and a resin, and a black toner containing at least a black colorant and a resin, wherein the magenta colorant comprises a quinacridone pigment having a number average primary particle size of from 30 to 150 nm and having a ratio of a major axis direction length to a minor axis direction length of from 1.0 to 2.0 and Pigment Red 238.

The toner of the invention provides a full color image without color contamination and with high chroma in which color reproduction range is increased as compared with a conventional full color toner. Further, the toner image formed employing the toner of the invention provides stable light resistance for a long term.

The toner of the invention provides a monochromatic image without color contamination and with excellent tint, and therefore, a secondary image formed employing the toner of the invention has a bright color tone.

The toner of the invention with excellent tint is a toner capable of fitting its hue angle to color reproduction of a photographic image.

The present invention relates to a toner for developing an electrostatic image comprising at least a resin and a colorant, and particular to a toner for developing an electrostatic image employing a specific colorant, which faithfully reproduces a color tone of a photographic image or an image formed on a display on a paper and provides stable light resistance.

The present inventors have found that a toner, comprising a specific quinacridone pigment having a specific particle size and a specific crystalline state, provides increased color gamut. The color gamut of a toner can be increased by improving dispersibility of the colorant in the toner due to reduction of the colorant particle size. However, only the reduction of the colorant particles is difficult to secure both high light resistance and increased color gamut. The present inventors have found that both high light resistance and increased color gamut are obtained by controlling the shape of the colorant particles as well as the particle size of the colorant particles, and when the specific quinacridone pigment is used in combination with Pigment Red 238, a color tone tinctured with red is obtained in addition to magenta color of the quinacridone pigment and by the combined use of the specific quinacridone pigment and color gamut reproduction range is increased, and have completed the invention.

The quinacridone pigment used in the invention has a number average primary particle size of from 30 to 150 nm and has a ratio of a major axis direction length to a minor axis direction length of from 1.0 to 2.0. Quinacridone pigment having a number average primary particle size less than 30 nm lowers light resistance of the pigment, which does not exhibit the effects of the invention. On the other hand, quinacridone pigment having a number average primary particle size exceeding 150 nm is likely to produce color contamination, and is difficult to obtain increased color gamut. Thus, it has been found that quinacridone pigment having a number average primary particle size of from 30 to 150 nm exhibits the effects of the invention. Quinacridone pigment having a number average primary particle size of from 30 to 100 nm exhibits the effects of the invention more effectively.

The quinacridone pigment in the invention has a ratio of a major axis direction length to a minor axis direction length of from 1.0 to 2.0. It has been found that a conventional quinacridone pigment having a ratio of a major axis direction length to a minor axis direction length exceeding 2.0 and having a more acicular structure tends to produce color contamination and lower light resistance. The reason that the quinacridone pigment having a ratio of a major axis direction length to a minor axis direction length exceeding 2.0 is likely to produce color contamination is unclear, but it is supposed that such acicular pigments, if the particle size of the pigments is small and the pigments are well dispersed in the toner particles, are likely to superimpose each other in the toner particles, resulting in color contamination. It is supposed that the pigment particles in a more acicular form are likely to produce structural deficiency within the particles, resulting in light deterioration and in lowering of light resistance.

In view of the above, it is considered that the pigment having a ratio of a major axis direction length to a minor axis direction length of from 1.0 to 2.0, which is approximately in the spherical form and has a structure with less protrusions, improves the dispersibility in the toner particles, whereby both increased color gamut and high light resistance are obtained.

The quinacridone pigment has a crystalline structure in which the quinacridone molecule skeletons of a plane structure are superimposed in the direction perpendicular to the molecular plane through hydrogen bonding due to the carbonyl group and the amino group so that the planes face each other. Accordingly, acicular particles having a large major axis direction length-to-minor axis direction length ratio are considered to be ones having higher crystallinity. Judging from the molecular skeleton of quinacridone, the direction perpendicular to the molecular plane shows aromaticity and high hydrophobic property, and the direction parallel with the molecular plane shows extremely low hydrophobic property due to the presence of the carbonyl group and the amino group, and as a result, it is supposed that it shows low hydrophobic property as compared with the direction perpendicular to the molecular plane. Accordingly, in order to improve dispersion of the quinacridone pigment in a resin, it is important to increase this hydrophobic property. The pigment having a low ratio of a major axis direction length to a minor axis direction length has a hydrophobic surface area larger than pigment having a high ratio of a major axis direction length to a minor axis direction length and has a high affinity to a resin used in the toner, and as a result, it is supposed that the dispersibility is improved and the color gamut can be increased. Further, it is supposed that in the pigment whose affinity to a resin is increased, the pigment site subjected to light deterioration is covered with the resin, resulting in improved light resistance.

The quinacridone pigment in the invention is not specifically limited as far as it has the characteristics as described above. Typical examples of the quinacridone pigment include a dimethylquinacridone pigment such as C.I. Pigment Red 122, a dichloroquinacridone pigment such as C.I. Pigment Red 202 or C.I. Pigment Red 209, and an unsubstituted quinacridone pigment such as C.I. Pigment Violet 19. Of these, C.I. Pigment Red 122 is especially preferred.

A mixture or solid solution composed of two or more kinds of the pigments as described above exhibits the effects of the invention. These pigments may be dry ones in the form of powder, granules or bulk, or wet ones in the form of wet cake or slurry.

The quinacridone pigment used in the invention can be prepared by the following procedures. A polyphosphoric acid solution containing 23 to 30% by weight of a known quinacridone pigment was poured into water to reprecipitate a crude quinacridone pigment. Successively, the resulting crude quinacridone pigment was introduced into a polar non-proton solvent in the absence of pulverizing media and subjected to heating treatment. After that, the polar non-proton solvent was removed from the resulting mixture solution to obtain a solid comprised mainly of the quinacridone pigment, and the resulting solid was subjected to washing, drying, and then pulverizing treatment to obtain a quinacridone pigment powder. Thus, the quinacridone pigment used in the invention is prepared.

In the above, the polyphosphoric acid solution contains a known quinacridone pigment in an amount of 23 to 30% by weight. When the polyphosphoric acid solution containing a quinacridone pigment in an amount as described above is stirred while heating, a slight amount of impurities, which serve as a crystal growth inhibiting substance, can be contained in the crude quinacridone pigment. A quinacridone pigment is added in a polyphosphoric acid solution at a temperature of 80 to 130° C., and stirred for one to ten hours while heating, whereby a polyphosphoric acid solution containing a quinacridone pigment can be prepared.

The polyphosphoric acid solution containing a quinacridone pigment as described above can be also a reaction solution prepared by a method in which for example, 2,5-dianilinoterephthalic acid is subjected to cyclization reaction in a polyphosphoric acid solution. This method is preferred in that the above crystal growth inhibiting substance is easily produced.

The above reprecipitation can be carried out by pouring the quinacridone pigment-containing polyphosphoric acid solution as described above into an excessive amount of water or a liquid medium such as an inorganic acid solution. For example, one weight part of the quinacridone pigment-containing polyphosphoric acid solution is poured into 3 to 15 weight parts of water or a liquid medium such as an inorganic acid solution. The crystal particles produced by the reprecipitation are filtered off to obtain wet cake containing a crude quinacridone pigment.

Examples of the polar non-proton solvent include dimethylsulfoxide, N-methyl-2-pyrrolidone, N,N-dimethylformamide, N,N-diethylformamide, and 1,3-dimethyl-2-imidazolidinone. A nitrogen-containing alicyclic organic solvent such as N-methyl-2-pyrrolidone or 1,3-dimethyl-2-imidazolidinone is preferred.

In the invention, C. I. Pigment Red 122 "CROMOPHTAL Jet Magenta DMQ" (produced by Ciba Japan Co., Ltd) is preferably used as the quinacridone pigment. This quinacridone pigment is in the spherical or cubic form, and has a number average primary particle size of from 50 to 100 nm and a specific surface area of from 85 to 95 $m^2/g$. In contrast, FASTOGEN Super Magenta RTS (produced by Dainippon Ink Chemical Co., Ltd.), which is a known C. I. Pigment Red 122 used hitherto, has a major axis direction length of from 150 to 250 nm, which is likely to form a more acicular structure, and has a specific surface area of from 65 to 75 $m^2/g$. That is, known C. I. Pigment Red 122, FASTOGEN Super Magenta RTS is different in the particle size or in the shape from the quinacridone pigment used in the invention.

In the invention, the toner contains a colorant comprising a quinacridone pigment having a number average primary particle size of from 30 to 150 nm and having a ratio of a major axis direction length to a minor axis direction length of from 1.0 to 2.0, whereby the effects of the invention are exhibited.

Herein, the number average primary particle size, major axis direction length, minor axis direction length, and major axis direction length to minor axis direction length ratio of the colorant in the invention can be determined employing a transmission electron microscope. Specifically, the Feret's diameters of arbitrarily selected 100 pigment particles on an electron micrograph of the pigment particles, which is taken at a 50000× magnification through a transmission electron microscope (TEM), are measured and the arithmetic average thereof are defined as the number average primary particle size of the pigment. Similarly, the major axis direction length and the minor axis direction refer to an arithmetic average of the lengths of the major axes and an arithmetic average of the lengths of the minor axes of arbitrarily selected 100 pigment particles, respectively, the particles being observed under an electron microscope at 50000× magnification.

The number average primary particle size, major axis direction length and minor axis direction length of a colorant as a toner material are measured through a transmission electron microscope, the quinacridone pigment being provided on a carbon grid. When the number average primary particle size, major axis direction length and minor axis direction length of the pigment dispersed in the resin of the toner are determined, toner pieces with a toner section obtained by cutting the toner particles are employed. The toner particles are sufficiently dispersed in an acryl resin capable of being cured at ordinary temperature to obtain acryl resin embedded toner particles, followed by curing. The resulting samples are cut into sample pieces having a thickness of 100 nm through a microtome with diamond blades. Thus, the toner pieces with a toner section are obtained.

With respect to definition of the major axis direction length and the minor axis direction length, explanation will be made below.

When two straight lines parallel to each other are drawn to be tangent to a projected pigment image at two points on the outer circumference of the projected image, a length of a straight line segment longest of straight line segments connecting the two points on the outer circumference of the projected image is defined as a major axis length, and the arithmetic average of the major axis lengths of arbitrarily selected 100 pigment particles is defined as a major axis direction length. And a length of a straight line segment, which is perpendicular to the longest straight line segment, runs through the center of the longest line segment, and has both ends on the outer circumference of the projected image, is defined as a minor axis length, and the arithmetic average of the minor axis lengths of arbitrarily selected 100 pigment particles is defined as a minor axis direction length.

The Pigment Red 238 used in the invention is a naphthol pigment. The number average primary particle size of the Pigment Red 238 is preferably from 10 to 200 nm, and more preferably from 30 to 150 nm. A certain degree of reduction of the particle size of Pigment Red 238 can contribute to color gamut increase. The particle size as described above can be obtained by controlling the dispersion conditions.

In the invention, the total content of the quinacridone pigment and Pigment Red 238 in the toner is preferably from 1 to 10% by weight, and more preferably from 3 to 7% by weight. The above content range of the quinacridone pigment and Pigment Red 238 in the toner is advantageous in that it improves coloring power of the toner and has no adverse effect on charging properties without separation from the toner or adhesion to a carrier of the pigment. The content ratio (by weight) of the quinacridone pigment to the Pigment Red 238 in the toner is preferably from 10:90 to 90:10, and more preferably from 30:70 to 70:30. This quinacridone pigment to Pigment Red 238 content ratio is advantageous in that color gamut is likely to increase.

The present invention provides a full color toner kit comprising plural colored toners, whereby a full color image can be formed. That is, a full color toner image can be formed employing a full color toner kit which is comprised of a magenta toner comprising at least a magenta colorant, Pigment Red 238 and a resin, a yellow toner comprising at least a yellow colorant and a resin, a cyan toner comprising at least a cyan colorant and a resin, and a black toner comprising at least a black colorant and a resin, wherein the magenta colorant includes a quinacridone pigment having a number average primary particle size of from 30 to 150 nm and having a ratio of a major axis direction length to a minor axis direction length of from 1.0 to 2.0.

In the invention, the full color toner kit refers to one set comprising plural colored toners used in combination to be installed in a full color image formation apparatus employing an electrophotographic process, or one set comprising a colorless toner in addition to the plural colored toners.

The colorants used in the toner constituting the full color toner kit of the invention will be explained. Examples of the black colorant for the black toner include carbon black, magnetic materials and titanium black. Typical examples of carbon black include Channel Black, Furnace Black. Acetylene Black, Thermal Black and Lamp Black. Typical examples of magnetic materials include ferromagnetic metals such as iron, nickel and cobalt; alloys containing ferromagnetic metals; ferromagnetic compounds such as ferrite and magnetite; and alloys, which do not contain ferromagnetic metals but are subjected to heat treatment to exhibit ferromagnetic property. Examples of the alloys subjected to heat treatment to exhibit ferromagnetic property include alloys called Hensler alloys such as manganese-copper-aluminum and manganese-copper-tin, and chromium dioxide.

Examples of the yellow colorant for the yellow toner include C.I. Solvent Yellow 19, 44, 77, 79, 81, 82, 93, 98, 103, 104, 112, and 162 as a dye; C.I. Pigment Yellow 14, 17, 74, 93, 94, 138, 155, 180 and 185 as a pigment; and a mixture thereof. Of these, CI. Pigment Yellow 74 is especially preferred.

Examples of the cyan colorant for the cyan toner include C.I. Pigment Blue 15:3.

The number average primary particle size of the yellow or cyan colorant dispersed in the toner is preferably from 10 to 200 nm, although it differs due to kind of the colorant. This number average primary particle size can be calculated from the transmission electron microscope photograph of the colorant in the same manner as the quinacridone pigment in the invention as described above.

The content of the yellow or cyan colorant in the toner is preferably from 1 to 10% by weight, and more preferably from 3 to 7% by weight. The above content range of the colorant in the toner is advantageous since it improves coloring power of the toner and has no adverse effect on charging properties without separation from the toner or adhesion to a carrier of the colorants.

Next, the particle size of the toner of the invention will be explained.

It is preferred that the toner of the invention has a volume based median size (also denoted simply as D50v) of from 3 to 8 μm. The volume based median size falling within the foregoing region can provide a fine dot image faithfully reproduced, for example, at a level of 1200 dpi (dpi represents the number of dots per inch or 2.54 cm).

One object of the invention is to provide the toner of the invention capable of faithfully carrying out a color reproduction of a photographic image. Such a minute particle size level that the volume based median size falls within the range as described above lessens the size of the dots constituting a photographic image, and makes it possible to obtain a photographic image with precision which is identical to or higher than a printed image. Specifically, in on-demand printing, in which orders for several hundreds to several thousands copies are received, high image quality prints with high-precision photographic images can be delivered to a user.

The volume based median size (D50v) of toner particles can be determined using Multisizer 3 (produced by Beckmann Coulter Co.), connected to a computer system for data processing.

The measurement procedure is as follows: 0.02 g of toner are added to 20 ml of a surfactant-containing solution (for example, a surfactant-containing solution obtained by diluting a surfactant-containing neutral detergent with pure water by a factor of 10) and subjected to ultrasonic dispersion to prepare a toner dispersion. Using a pipette, the toner dispersion is poured into a beaker having ISOTON II (produced by Beckman Coulter Co.) within a sample stand, until reaching a measurement concentration of 5 to 10%. The measurement count was set to 2,500 to perform measurement. The aperture diameter of Multisizer 3 is 50 μm.

The toner of the invention has a coefficient of variation (CV value) in the volume based particle size distribution of preferably from 2 to 21%, and more preferably from 5 to 15%.

The coefficient of variation (CV value) in the volume based particle size distribution represents a dispersion degree of toner particle size, in terms of volume, and defined by the following formula:

$CV$ value(%)=(standard deviation in the volume based particle size distribution)×100/{median size ($D50v$) in the volume based particle size distribution}

A lower value of CV indicates a sharper particle size distribution, and means that the particle size tends to be uniform. Uniform particle size enables more precise reproduction of fine-dot images or fine lines, which is required in digital image formation. Printing a photographic image with uniform-sized toner particles results in photographic images of high image quality at a level equivalent to or higher than an image prepared by printing ink.

The toner of the invention has a softening point (Tsp) of preferably from 70 to 110° C., and more preferably 70 to 100° C. Colorants used in the toner of the invention are stable and do not cause any change in the spectrum even when heat is applied. A softening point falling with the foregoing range can reduce effects of heat applied to the toner on fixing. Accordingly, image formation is performed without relying on a colorant, so that a broad stable color reproduction is expected.

A toner with a softening point falling within the foregoing range enables fixing a toner image at a temperature lower than the prior art, rendering it feasible to perform image formation at reduced power consumption and friendly to environments.

The softening point of toner can be controlled by the following methods, singly or in combination thereof.

(1) the kind or the composition of monomer used for resin formation is adjusted;

(2) the molecular weight of a resin is controlled by the kind or the amount of a chain-transfer agent;

(3) the kind or amount of a wax is controlled.

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa while heating at a temperature rising rate of 6° C./min, and extruded from a nozzle with a length of 1 mm and a diameter of 1 mm, whereby a curve (softening flow curve) between plunger-drop and temperature is drawn. The temperature at which flowing-out is initiated is defined as a melt-initiation temperature, and the temperature corresponding to a 5 mm drop is defined as a softening temperature.

Next, a method of preparing the toner of the invention will be explained.

The toner of the invention is comprised of particles (hereinafter also referred to as colored particles) containing at least a resin and a colorant. The toner of the invention can be prepared according a conventional toner preparing method, which is not specifically limited. That is, the toner can be prepared applying a so-called pulverizing method, in which toner is prepared through kneading, pulverizing and classification, or a so-called polymerization toner preparation method in which a polymerizable monomer is polymerized and at the same time particle formation is carried out while controlling the shape or size of the particles (for example, an emulsion polymerization method, a suspension polymerization method or a polyester elongation method).

When the toner of the invention is prepared through a pulverizing method, kneading is preferably performed at a temperature of not more than 130° C. When a mixture is kneaded at a temperature exceeding 130° C., heat applied to the mixture tends to change the aggregation state of a colorant in the mixture, rendering it difficult to maintain uniform aggregation of the colorant. There is problem in that variation in the aggregation state causes variations in color tone of the prepared toner, resulting in color contamination.

Next, a resin contained in the toner of the invention or wax which can contain in the toner of the invention will be explained with reference to typical examples.

A resin usable for the toner of the invention is not specifically limited, and is typically a polymer prepared by polymerization of polymerizable monomers which are called vinyl monomers. The polymer is comprised of a polymer prepared by polymerization of at least one polymerizable monomer, which is prepared by polymerizing the vinyl monomers singly or an admixture of two or more kinds thereof.

Typical examples of a polymerizable vinyl monomer will be listed below:

(1) Styrene or Styrene Derivatives:

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, etc.;

(2) Methacrylic Acid Ester Derivatives:

Methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc.;

(3) Acrylic Acid Ester Derivatives:

Methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, phenyl acrylate, etc.;

(4) Olefins:

Ethylene, propylene, isobutylene, etc.;

(5) Vinyl Esters:

Vinyl propionate, vinyl acetate, vinyl benzoate, etc.;

(6) Vinyl Ethers:

Vinyl methyl ether, vinyl ethyl ether, etc.;

(7) Vinyl Ketones:

Vinyl methyl ketone, vinyl ethyl ketone, vinyl hexyl ketone, etc.;

(8) N-Vinyl Compounds:

N-Vinyl carbazole, N-vinyl indole, N-vinyl pyrrolidone, etc.;

(9) Others:

Vinyl compounds such as vinylnaphthalene and vinylpyridine; acrylic acid or methacrylic acid derivatives such as acrylonitrile, methacrylonitrile and acrylamide; and so on.

As the polymerizable vinyl monomer unit constituting the resin used in the toner of the invention, ones having an ionic dissociation group as described later can be used. As the resin used in the toner of the invention is preferably used a resin obtained by polymerization or copolymerization of a monomer having in the side chain an ionic dissociation group such as a carboxyl group, a sulfonic acid group or a phosphoric acid group, i.e., a polymer (copolymer) having an ionic dissociation group such as a carboxyl group, a sulfonic acid group or a phosphoric acid group, whereby dispersion in the resin of the colorant (pigment) used in the invention can be improved. Typical examples of such a monomer will be shown below.

Typical examples of a monomer having a carboxyl group include acrylic acid, methacrylic acid, maleic acid, itaconic acid, cinnamic acid, fumaric acid, monoalkyl maleate, and monoalkyl itaconate. Typical examples of the monomers having a sulfonic acid group include styrene sulfonic acid, allylsulfosuccinic acid, and 2-acrylamido-2-methylpropane sulfonic acid. Typical examples of the monomers having a phosphoric acid group include acid phosphooxyethyl methacrylate.

Further, a cross-linked resin can be prepared using a polyfunctional monomer described below.

Typical examples of the polyfunctional monomer include divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

As the resin used in the invention, there is mentioned a polycondensation polymer such as a polyester resin.

The resin content of the toner is preferably from 65 to 98% by weight.

The toner of the invention may contain wax. The waxes usable in the toner of the invention are those known in the art as listed below:

(1) Polyolefin Wax

Polyethylene wax, polypropylene wax etc.;

(2) Long Chain Hydrocarbon Wax

Paraffin wax, sasol wax, etc.;

(3) Dialkyl Ketone Wax

Distearyl ketone, etc.;

(4) Ester Wax

Carnauba wax, montan wax, timethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristearate, distearyl meleate etc.;

(5) Amide Wax

Ethylenediamine dibehenylamide, trimellitic acid tristearylamide, etc.

The melting point of wax is ordinarily 40 to 125° C., preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is in the range of preferably from 1 to 30% by weight, and more preferably from 5 to 20% by weight.

During a process of manufacturing the toner of the invention, the toner may be added with inorganic particles having a number average primary particle size of from 4 to 800 nm or organic particles as an external additive.

Addition of the external additive improves fluidity or electrostatic property of toner and achieves enhanced cleaning ability. The kind of the external additives is not specifically limited, and examples thereof include inorganic particles, organic particles and a lubricant, as described below.

There are usable commonly known inorganic particles and preferred examples thereof include silica, titania, alumina and strontium titanate particles. There may optionally be used inorganic particles which have been subjected to hydrophobilization treatment.

Specific examples of silica particles include R-976, R-974, R-972, R-812 and R-809 which are commercially available from Nippon Aerosil Co., Ltd.; INK-2150 and H-200 which are commercially available from Hoechst Co.; and TS-720, TS-530, TS-610, H-5 and MS-5 which are commercially available from Cabot Co.

Examples of titania particles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which are commercially available from Fuji Titan Co., Ltd.; and IT-S, IT-OB and IT-OC which are commercially available from Idemitsu Kosan Co., Ltd.

Examples of alumina particles include RFY-C and C-604 which are commercially available from Nippon Aerosil Co., Ltd.; and TTO-55, which is commercially available from Ishihara Sangyo Co., Ltd.

As the organic particles, spherical organic particles having a number-average primary particle size of 10 to 2000 nm are usable. Specifically, there is usable a homopolymer or copolymer of styrene or methyl methacrylate.

Lubricants such as a metal salt of a higher fatty acid can be used in order to achieve enhanced cleaning ability or transferability. Examples of the metal salt of the higher fatty acid include a zinc, copper, magnesium or calcium salt of stearic acid; a zinc, manganese, iron, copper or magnesium salt of oleic acid; a zinc, copper, magnesium or calcium salt of palmitic acid; a zinc or calcium salt of linolic acid; and a zinc or calcium salt of ricinolic acid.

The content of such an external additive or lubricant in the toner is preferably from 0.1 to 10.0% by weight. Addition of the external additive or lubricant can be conducted using various known mixing devices such as a turbuler mixer, a Henschel mixer, a Nauter mixer and a V-shape mixer.

The toner of the invention is usable as a two-component developer comprised of a carrier and a toner or as a non-magnetic single-component developer comprised of a toner alone.

The use of the toner of the invention as a two-component developer enables full-color printing by using a tandem system image formation apparatus, as described later.

As a carrier which is magnetic particles used in a two-component developer, there can be used known materials, e.g., metals such as iron, ferrite and magnetite and alloys of the foregoing metals and a metal such as aluminum or lead. Of these, ferrite particles are preferred. The volume-average particle size of a carrier is preferably from 15 to 100 μm, and more preferably from 25 to 80 μm.

When image formation is carried out employing a non-magnetic single-component developer without a carrier, the toner is charged by being rubbed or pressed onto the surface of a charging member or a developing roller. Image formation employing a nonmagnetic single-component development system can simplify the structure of a developing device, resulting in advantages of manufacturing a compact image formation apparatus. Therefore, when the toner of the invention is employed as a single-component developer, a full-color printing can be conducted through a compact color printer, making it feasible to prepare full-color prints of excellent color reproduction even in a space-limited working environment.

Next, an image formation method employing the toner of the invention will be explained. Firstly, an image formation method employing the toner of the invention as a two-component developer will be explained.

FIG. 1 is a schematic view of one example of an image formation apparatus in which the toner of the invention is usable as a two-component developer.

In FIGS. 1, 1Y, 1M, 1C and 1K each designate a photoreceptor; 4Y, 4M, 4C and 4K each designate a developing device (a developing means); 5Y, 5M, 5C and 5K each designate a primary transfer roller as a primary transfer means; 5A designates a secondary transfer roller as a secondary transfer means; 6Y, 6M, 6C and 6K each designate a cleaning means; the numeral 7 designates an intermediate transfer unit; the numeral 24 designates a thermal roll fixing device; and the numeral 70 designates an intermediate transfer material.

This image formation apparatus is called a tandem color image formation apparatus, which is composed of a housing 8 comprising plural image formation sections 10Y, 10M, 10C and 10B and an endless belt intermediate transfer material unit 7 as a transfer section, a paper feeding and conveying means 21 to convey recording member P, and a heat roll fixing device 24 as a fixing means. A reading device SC for reading an original is disposed in the upper section of the image formation apparatus body A. The housing 8 is disposed in the image formation apparatus body A so that it can be pulled out from the image formation apparatus body A through supporting rails 82L and 82R.

Image formation section 10Y to form a yellow image as one of a different color toner image formed on the respective photoreceptors comprises a drum-shaped photoreceptor 1Y as a first photoreceptor and disposed around the photoreceptor 1Y, a charging means 2Y, an exposure means 3Y, a developing means 4Y, a primary transfer roller 5Y as a primary transfer means and a cleaning means 6Y. Image formation section 10M to form a magenta image as one of another different color toner image comprises a drum-shaped photoreceptor 1M as a first photoreceptor and disposed around the photoreceptor 1M, a charging means 2M, an exposure means 3M, a developing means 4M, a primary transfer roller 5M as a primary transfer means and a cleaning means 6M. Image formation section 10C to form a magenta image as one of still another different color toner image comprises a drum-shaped photoreceptor 1C as a first photoreceptor and disposed around the photoreceptor 1C, a charging means 2C, an exposure means 3C, a developing means 4C, a primary transfer roller 5C as a primary transfer means and a cleaning means 6C.

Image formation section 10K to form a black image as one of still further another different color toner image comprises a drum-shaped photoreceptor 1K as a first photoreceptor and disposed around the photoreceptor 1K, a charging means 2K, an exposure means 3K, a developing means 4K, a primary transfer roller 5K as a primary transfer means and a cleaning means 6K.

An endless belt intermediate transfer unit 7, which is turned by plural rollers 71, 72, 73, 74, 76 and 77, comprises an endless belt intermediate transfer material 70 as a second image carrier in the endless belt form, which is pivotably supported.

The individual color images formed in image formation sections 10Y, 10M, 10C and 10K are successively transferred onto the rotating endless belt intermediate transfer material 70 by primary transfer rollers 5Y, 5M, 5C and 5K, respectively, to form a composite color image. Recording member P such as paper or the like as a transfer material housed in paper feed cassette 20 is fed by a paper feed and conveyance means 21 and conveyed to a secondary transfer roller 5A through plural intermediate rollers 22A, 22B, 22C and 22D and a resist roller 23, where color images are transferred together on recording member P. The recording member P with the transferred color images is fixed by a heat-roll type fixing device 24, nipped by a paper discharge roller 25, and put onto a paper discharge tray 26 outside a machine.

After a color image is transferred onto recording member P by a secondary transfer roller 5A, any residual toner which remains on the endless belt intermediate transfer material 70 from which the recording member P is separated is removed by a cleaning means 6A.

During image formation, the primary transfer roller 5K is always in contact with the photoreceptor 1K. Other primary rollers 5Y, 5M and 5C are brought into contact with the photoreceptors 1Y, 1M and 1C, respectively, only at the time when color images are formed on the photoreceptors 1Y, 1M and 1C.

The secondary transfer roller 5A is brought into contact with the endless belt intermediate transfer material 70 only when secondary transfer to recording material P is carried out.

Thus, toner images are formed on photoreceptors 1Y, 1M, 1C and 1K, through electrostatic-charging, exposure and development. The resulting toner images having a different color are superimposed on the endless belt intermediate transfer material 70, transferred together onto recording member P and fixed by compression and heating in the heat-roll type fixing device 24. After completion of transferring a toner image to recording member P, any toner remained on the photoreceptors 1Y, 1M, 1C and 1K is removed by cleaning device 6A, whereby the intermediate transfer material 70 is cleaned, and then goes into the foregoing cycle of electrostatic-charging, exposure and development to perform the subsequent image formation.

When the toner of the invention is used as a non-magnetic single-component developer for image formation, the two-component developing means are changed to a nonmagnetic single-component developing means.

The fixing method is not specifically limited, and may be any fixing method. There are, for example, a method employing a heat roller and a pressure roller, a method employing a heat roller and a pressure belt, a method employing a heat belt and a pressure roller, and a method employing a heat belt and a pressure belt. As heating methods, any known heating methods such as a method employing a halogen lamp and a method employing IH may be used.

EXAMPLES

The embodiments of the invention will be explained employing examples, but the invention is by no means limited to these.

1. Preparation of Quinacridone Pigment (1) Preparation of Quinacridone Pigment 1

A mixture of 108 weight parts of an aqueous 85% phosphoric acid solution and 162 weight parts of phosphoric acid anhydride was stirred for 20 minutes in a reaction vessel with a stirrer to obtain 270 weight parts of polyphosphoric acid with a phosphoric acid anhydride content of 84.6% by weight. The resulting polyphosphoric acid was further added with 100 weight parts of 2,5-dianilinoterephthalic acid, and stirred at 125° C. for 3 hours to obtain a polyphosphoric acid solution containing 24.4% by weight of quinacridone compound.

The resulting polyphosphoric acid solution was poured into 1500 weight parts of 0° C. water in a vessel with a stirrer with vigorous stirring, and further stirred for additional 30 minutes to obtain precipitates. The resulting precipitates were filtered off, and washed with water to obtain 290 weight parts of crude unsubstituted quinacridone pigment wet cake (with a solid content of 30%).

In another reaction vessel with a stirrer were mixed 290 weight parts of the crude unsubstituted quinacridone pigment wet cake obtained above, 520 weight parts of N-methyl-2-pyrrolidone and 150 weight parts of water, and stirred at 90° C. for 7 hours. Thereafter, the resulting mixture was cooled to room temperature, and the resulting precipitates were filtered off, washed with hot water, dried and pulverized. Thus, 84 weight parts of quinacridone pigment (C.I. Pigment Violet 19) were obtained. This quinacridone pigment was designated as Quinacridone Pigment 1. The number average primary particle size, the major axis direction length, the minor axis direction length and the ratio of the major axis direction length to the minor axis direction length of Quinacridone Pigment 1 were 22 nm, 26 nm, 18 nm, and 1.44, respectively (2) Preparation of Quinacridone Pigment 2

Quinacridone Pigment 2 was prepared in the same manner as Quinacridone Pigment 1, except that the polyphosphoric acid solution was poured into 1500 weight parts of 5° C. water in a vessel with a stirrer with vigorous stirring. The number average primary particle size, the major axis direction length, the minor axis direction length and the ratio of the major axis direction length to the minor axis direction length of Quinacridone Pigment 2 are as shown in Table 1.

(3) Preparation of Quinacridone Pigment 3

Quinacridone Pigment 3 was prepared in the same manner as Quinacridone Pigment 1, except that the polyphosphoric acid solution was poured into 1500 weight parts of 10° C. water in a vessel with a stirrer with vigorous stirring. The number average primary particle size, the major axis direction length, the minor axis direction length and the ratio of the major axis direction length to the minor axis direction length of Quinacridone Pigment 3 are as shown in Table 1.

(4) Preparation of Quinacridone Pigment 4

Quinacridone Pigment 4 was prepared in the same manner as Quinacridone Pigment 1, except that the polyphosphoric acid solution was poured into 1500 weight parts of 15° C. water in a vessel with a stirrer with vigorous stirring. The number average primary particle size, the major axis direction length, the minor axis direction length and the ratio of the major axis direction length to the minor axis direction length of Quinacridone Pigment 4 are as shown in Table 1.

(5) Preparation of Quinacridone Pigment 5

Into a reaction vessel with a stirrer were placed 100 weight parts of an aqueous 85% phosphoric acid solution and 150 weight parts of phosphoric acid anhydride, and stirred for 20 minutes to obtain 250 weight parts of polyphosphoric acid with a phosphoric acid anhydride content of 84.6% by weight. The resulting reaction mixture was further added with 80 weight parts of FASTOGEN Super Magenta RTS produced by Dainippon Ink Chemical Co., Ltd. (dimethylquinacridone pigment, C.I. Pigment Red 122), and stirred at 140° C. for 3 hours to obtain a polyphosphoric acid solution containing 24.4% by weight of the quinacridone compound.

The resulting polyphosphoric acid solution was poured into 1500 weight parts of 0° C. water in a vessel with a stirrer with vigorous stirring, and further stirred for additional 30 minutes to obtain precipitates. The resulting precipitates were filtered off; and washed with water to obtain 265 weight parts of crude dimethylquinacridone pigment wet cake (with a solid content of 30%).

Into another reaction vessel with a stirrer were placed 265 weight parts of the crude dimethylquinacridone pigment wet cake as obtained above, 520 weight parts of N-methyl-2-pyrrolidone and 150 weight parts of water, and stirred at 90° C. for 7 hours. Thereafter, the resulting reaction mixture was cooled to room temperature, and the resulting precipitates were filtered off, washed with hot water, dried and pulverized. Thus, 77 weight parts of dimethylquinacridone pigment were obtained. This dimethylquinacridone pigment was designated as Quinacridone Pigment 5. The number average primary particle size, the major axis direction length, the minor axis direction length and the ratio of the major axis direction length to the minor axis direction length of Quinacridone Pigment 5 are as shown in Table 1.

(6) Preparation of Quinacridone Pigment 6

A mixture of 70 weight parts of "CROMOPHTAL Jet Magenta DMQ (produced by Ciba Japan Co., Ltd.)", (C.I. Pigment Red 122), 290 weight parts of isobutanol and 380 weight parts of water was placed into a reaction vessel with a stirrer and stirred at 130° C. for 7 hours. Thereafter, the resulting mixture was cooled to room temperature, and the resulting precipitates were filtered off, washed with hot water, dried and pulverized to obtain a quinacridone pigment. This quinacridone pigment was designated as Quinacridone Pigment 6. The number average primary particle size, major axis direction length, minor axis direction length and a ratio of a major axis direction length to minor axis direction length of Quinacridone Pigment 6 are as shown in Table 1.

(7) Preparation of Quinacridone Pigment 7

A mixture of 108 weight parts of an aqueous 85% phosphoric acid solution and 162 weight parts of phosphoric acid anhydride was stirred for 20 minutes in a reaction vessel with a stirrer to obtain 270 weight parts of polyphosphoric acid with a phosphoric acid anhydride content of 84.6% by weight. The resulting polyphosphoric acid was further added with 95 weight parts of 2,5-dianilinoterephthalic acid and 5 weight parts of "Permanent Red FGR02 produced by Clariant Japan Co., Ltd.", (dimethylquinacridone pigment, C.I. Pigment Red 122), and stirred at 125° C. for 3 hours to obtain a polyphosphoric acid solution containing 24.4% by weight of the quinacridone compound.

The resulting polyphosphoric acid solution was poured into 1500 weight parts of 15° C. water in a vessel with a stirrer with vigorous stirring, and further stirred for additional 30 minutes to obtain precipitates. The resulting precipitates were filtered off, and washed with water to obtain 290 weight parts of crude quinacridone pigment wet cake (with a solid content of 30%).

In another reaction vessel with a stirrer were mixed 290 weight parts of the crude quinacridone pigment wet cake as obtained above, 550 weight parts of N-methyl-2-pyrrolidone and 120 weight parts of water, and stirred at 100° C. for 7 hours. Thereafter, the resulting mixture was cooled to room temperature, and the resulting precipitates were filtered off, washed with hot water, dried and pulverized. Thus, 85 weight parts of quinacridone pigment were obtained. This quinacridone pigment was designated as Quinacridone Pigment 7. The number average primary particle size, the major axis direction length, the minor axis direction length and the ratio of the major axis direction length to the minor axis direction length of Quinacridone Pigment 7 are as shown in Table 1.

(8) Preparation of Quinacridone Pigment 8

A mixture of 70 weight parts of "Fastogen Super Magenta RE-25 (produced by Dainippon Ink Chemical Co., Ltd.)", (C.I. Pigment Red 122), 290 weight parts of isobutanol and 380 weight parts of water was stirred at 130° C. for 7 hours in a reaction vessel with a stirrer. Thereafter, the resulting mixture was cooled to room temperature, and the resulting precipitates were filtered off, washed with hot water, dried and pulverized. Thus, quinacridone pigment was obtained. This quinacridone pigment was designated as Quinacridone Pigment 8. The number average primary particle size, the major axis direction length, the minor axis direction length and the ratio of the major axis direction length to the minor axis direction length of Quinacridone Pigment 8 are as shown in Table 1.

(9) Preparation of Quinacridone Pigment 9

Quinacridone Pigment 9 was prepared in the same manner as Quinacridone Pigment 7, except that the polyphosphoric acid solution was poured into 1500 weight parts of 20° C. water in a vessel with a stirrer with vigorous stirring. The number average primary particle size, the major axis direction length, the minor axis direction length and the ratio of the major axis direction length to the minor axis direction length of Quinacridone Pigment 9 are as shown in Table 1.

(10) Preparation of Quinacridone Pigment 10

Quinacridone Pigment 10 was prepared in the same manner as Quinacridone Pigment 7, except that the polyphosphoric acid solution was poured into 1500 weight parts of 25° C. water in a vessel with a stirrer with vigorous stirring. The number average primary particle size, the major axis direction length, the minor axis direction length and the ratio of the major axis direction length to the minor axis direction length of Quinacridone Pigment 10 are as shown in Table 1.

(11) Preparation of Quinacridone Pigment 11

Quinacridone Pigment 11 was prepared in the same manner as Quinacridone Pigment 7, except that the polyphosphoric acid solution was poured into 1500 weight parts of 35° C. water in a vessel with a stirrer with vigorous stirring. The number average primary particle size, the major axis direction length, the minor axis direction length and the ratio of the major axis direction length to the minor axis direction length of Quinacridone Pigment 11 are as shown in Table 1.

(12) Preparation of Quinacridone Pigment 12

A mixture of 120 weight parts of an aqueous 85% phosphoric acid solution and 180 weight parts of phosphoric acid anhydride was stirred for 20 minutes into a reaction vessel with a stirrer to obtain 300 weight parts of polyphosphoric acid with a phosphoric acid anhydride content of 84.6% by weight. The resulting reaction mixture was further added with 100 weight parts of 2,5-dianilinoterephthalic acid, and stirred at 125° C. for 3 hours to obtain a polyphosphoric acid solution containing 22.5% by weight of quinacridone compound.

The resulting polyphosphoric acid solution was poured into 1500 weight parts of 15° C. water in a vessel with a stirrer with vigorous stirring, and further stirred for additional 30 minutes to obtain precipitates. The resulting precipitates were filtered off, and washed with water to obtain 290 weight parts of crude unsubstituted quinacridone pigment wet cake (with a solid content of 30%).

In another reaction vessel with a stirrer were mixed 290 weight parts of the crude unsubstituted quinacridone pigment wet cake obtained above, 290 weight parts of isobutanol, and 380 weight parts of water, and stirred at 130° C. for 7 hours. Thereafter, the resulting mixture was cooled to room temperature, and the resulting precipitates were filtered off, washed with hot water, dried and pulverized. Thus, 84 weight parts of unsubstituted quinacridone pigment were obtained. This quinacridone pigment was designated as Quinacridone Pigment 12. The number average primary particle size, the major axis direction length, the minor axis direction length and the ratio of the major axis direction length to the minor axis direction length of Quinacridone Pigment 12 are as shown in Table 1.

(13) Preparation of Quinacridone Pigment 13

A mixture of 70 weight parts of "Fastogen Super Magenta RTS (produced by Dainippon Ink Chemical Co., Ltd.)", (C.I. Pigment Red 122), 290 weight parts of isobutanol and 380 weight parts of water was stirred at 130° C. for 7 hours in a reaction vessel with a stirrer. Thereafter, the resulting mixture was cooled to room temperature, and the resulting precipitates were filtered off, washed with hot water, dried and pulverized. Thus, quinacridone pigment was obtained. This quinacridone pigment was designated as Quinacridone Pigment 13. The number average primary particle size, the major axis direction length, the minor axis direction length and the ratio of the major axis direction length to the minor axis direction length of Quinacridone Pigment 13 are as shown in Table 1.

TABLE 1

| Quinacridone Pigment No. | Quinacridone Pigment | (a) | (b) | (c) | (d) |
|---|---|---|---|---|---|
| 1 | C.I. Pigment Violet 19 | 22 | 26 | 18 | 1.44 |
| 2 | C.I. Pigment Violet 19 | 32 | 35 | 28 | 1.25 |
| 3 | C.I. Pigment Violet 19 | 45 | 49 | 38 | 1.29 |
| 4 | C.I. Pigment Violet 19 | 56 | 67 | 42 | 1.60 |
| 5 | C.I. Pigment Red 122 | 78 | 91 | 61 | 1.49 |
| 6 | C.I. Pigment Red 122 | 89 | 91 | 88 | 1.03 |
| 7 | Solid Solution of C.I. Pigment Violet 19 & C.I. Pigment Red 122 | 99 | 122 | 76 | 1.61 |
| 8 | C.I. Pigment Red 122 | 119 | 123 | 115 | 1.07 |
| 9 | Solid Solution of C.I. Pigment Violet 19 & C.I. Pigment Red 122 | 120 | 152 | 92 | 1.65 |
| 10 | Solid Solution of C.I. Pigment Violet 19 & C.I. Pigment Red 122 | 145 | 178 | 93 | 1.91 |
| 11 | Solid Solution of C.I. Pigment Violet 19 & C.I. Pigment Red 122 | 160 | 176 | 139 | 1.27 |
| 12 | C.I. Pigment Violet 19 | 89 | 140 | 57 | 2.46 |
| 13 | C.I. Pigment Red 122 | 160 | 250 | 111 | 2.25 |

(a) Number Average Primary Particle Size (nm)
(b) Major Axis Direction Length (nm)
(c) Minor Axis Direction Length (nm)
(d) Ratio of Major Axis Direction Length to Minor Axis Direction Length 2. Preparation of Developer (Preparation of Magenta Toner Via Kneading-Pulverizing Method)

The toner composition described below was placed in a HENSCHEL MIXER (produced by Mitsui-Miike Kogyo Co. Ltd.) and mixed with stirring at a blade circumferential speed of 25 m/second for 5 minutes.

| | |
|---|---|
| Polyester resin (Condensation product of bisphenol A-ethylene oxide adduct, terephthalic acid and trimellitic acid having a weight average molecular weight of 20,000) | 100 weight parts |

-continued

| | |
|---|---|
| Quinacridone Pigment as shown in Table 1 and/or Pigment Red 238 | Amount (weight parts) as shown in Table 2 |
| Releasing agent (Pentaerythritol tetrastearate) | 6 weight parts |
| Charge controlling agent (Boron dibenzylic acid complex) | 1 weight part |

These values are ones determined according to a transmission electron microscope as described previously. The quinacridone pigment contained in each of Inventive Magenta Toners 1 through 9 and Comparative Magenta Toners 1 through 6, the number average primary particle size, the major axis direction length, the minor axis direction length and the ratio of the major axis direction length to the minor axis direction length of the quinacridone pigment dispersed in each toner, and the number average primary particle size of the Pigment Red 238 dispersed in each toner are collectively shown in Table 2.

TABLE 2

| | | | | | | | Pigment Red 238 | |
|---|---|---|---|---|---|---|---|---|
| Magenta Toner No. | Quinacridone Pigment No. used | (a) | (b) | (c) | (d) | Addition Amount (Weight parts) | (a) | Addition Amount (Weight parts) |
| 1 (Inv.) | 2 | 33 | 37 | 29 | 1.28 | 3 | 100 | 2 |
| 2 (Inv.) | 3 | 47 | 50 | 39 | 1.28 | 2 | 100 | 4 |
| 3 (Inv.) | 4 | 55 | 66 | 42 | 1.57 | 1 | 100 | 3 |
| 4 (Inv.) | 5 | 76 | 90 | 62 | 1.45 | 3 | 100 | 5 |
| 5 (Inv.) | 6 | 88 | 90 | 88 | 1.02 | 4 | 100 | 3 |
| 6 (Inv.) | 7 | 89 | 120 | 76 | 1.58 | 3 | 100 | 2 |
| 7 (Inv.) | 8 | 120 | 120 | 113 | 1.06 | 2.5 | 60 | 2.5 |
| 8 (Inv.) | 9 | 119 | 151 | 92 | 1.64 | 2.5 | 90 | 2.5 |
| 9 (Inv.) | 10 | 147 | 176 | 93 | 1.89 | 2.5 | 120 | 2.5 |
| 1 (Comp.) | 1 | 22 | 27 | 18 | 1.50 | 2.5 | 120 | 2.5 |
| 2 (Comp.) | 11 | 160 | 174 | 139 | 1.25 | 2.5 | 120 | 2.5 |
| 3 (Comp.) | 12 | 88 | 144 | 58 | 2.48 | 2.5 | 120 | 2.5 |
| 4 (Comp.) | 13 | 167 | 253 | 110 | 2.30 | 2.5 | 120 | 2.5 |
| 5 (Comp.) | 7 | 89 | 120 | 76 | 1.58 | 5 | — | — |
| 6 (Comp.) | None | — | — | — | — | — | 100 | 5 |

Inv.: Inventive,
Comp.: Comparative
(a) Number Average Primary Particle Size (nm)
(b) Major Axis Direction Length (nm)
(c) Minor Axis Direction Length (nm)
(d) Ratio of Major Axis Direction Length to Minor Axis Direction Length The resulting mixture was kneaded in a biaxial extrusion kneader, then roughly pulverized in a hammer mill, further pulverized in a turbo-mill (produced by TURBO KOGYO Co., Ltd.), and subjected to powder classification in an air stream classifier employing Coanda effect to obtain colored particles having a volume based median size of 5.5 μm.

Next, the following external additives were added to the colored particles obtained above, and subjected to external addition treatment in a HENSCHEL MIXER (produced by Mitsui-Miike Kogyo Co., Ltd.). Thus, Inventive Magenta Toners 1 through 9 and Comparative Magenta Toners 1 through 6 were prepared.

| | |
|---|---|
| Hexamethylsilazane-treated silica (with an average primary particle size of 12 nm) | 0.6% by weight |
| n-Octylsilane-treated titanium dioxide (with an average primary particle size of 24 nm) | 0.8% by weight |

The external treatment in the HENSCHEL MIXER was conducted at 35° C. for 15 minutes under condition of a stirring blade circumferential speed of 35 m/second.

The number average primary particle size, the major axis direction length, the minor axis direction length and the ratio of the major axis direction length to the minor axis direction length of the quinacridone pigment employed in each of Inventive Magenta Toners 1 through 9 and Comparative Magenta Toners 1 through 6 above are shown in Table 1.

(Preparation of Magenta Toner Via Emulsion Coagulation Method)

(1) Preparation of Colorant Particle Dispersion

Sodium n-dodecylsulfate of 11.5 weight parts was poured into 160 weight parts of deionized water, and dissolved with stirring to prepare an aqueous surfactant solution. Quinacridone Pigment and/or Pigment Red 238 as shown in Table 3-1 were gradually added in an amount as shown in Table 3-1 to this aqueous surfactant solution and dispersed using CLEAR MIX W-motion CLM-0.8 (produced by M Technique Co.) to obtain Colorant Particle Dispersions 1 through 15.

TABLE 3-1

| Colorant Particle Dispersion No. | Quinacridone Pigment No. used | Addition Amount (Weight Parts) | Pigment used | Addition Amount (Weight Parts) |
|---|---|---|---|---|
| 1 | 1 | 2.5 | Pigment Red 238 | 2.5 |
| 2 | 2 | 3 | " | 2 |
| 3 | 3 | 2 | " | 4 |
| 4 | 4 | 1 | " | 3 |
| 5 | 5 | 3 | " | 5 |
| 6 | 6 | 4 | " | 3 |
| 7 | 7 | 3 | " | 2 |
| 8 | 8 | 2.5 | " | 2.5 |
| 9 | 9 | 2.5 | " | 2.5 |
| 10 | 10 | 2.5 | " | 2.5 |
| 11 | 11 | 2.5 | " | 2.5 |

TABLE 3-1-continued

| Colorant Particle Dispersion No. | Quinacridone Pigment No. used | Addition Amount (Weight Parts) | Pigment used | Addition Amount (Weight Parts) |
|---|---|---|---|---|
| 12 | 12 | 2.5 | " | 2.5 |
| 13 | 13 | 2.5 | " | 2.5 |
| 14 | 6 | 5 | None | — |
| 15 | None | — | " | 5 |

(2) Preparation of Core Resin Particle 1

Core Resin Particle 1 having a multilayer structure was prepared through a first step polymerization, a second step polymerization and a third step polymerization as described below.

(a) First Step Polymerization

Into a reaction vessel fitted with a stirrer, a temperature sensor, a condenser and a nitrogen gas-introducing device was placed 4 weight parts of an anionic surfactant represented by the following formula I together with 3040 weight parts of deionized water to prepare an aqueous surfactant solution.

$$C_{10}H_{21}(OCH_2CH_2)_2SO_3Na \qquad \text{Formula I}$$

A polymerization initiator solution, in which 10 weight parts of potassium persulfate (KPS) were dissolved in 400 weight parts of deionized water, was added to the foregoing aqueous surfactant solution, and heated to 75° C. Then, a mixed monomer solution comprised of the following compounds was dropwise added to the resulting solution in the reaction vessel in 1 how.

| | |
|---|---|
| Styrene | 532 weight parts |
| n-Butyl acrylate | 200 weight parts |
| Methacrylic acid | 68 weight parts |
| n-Octyl mercaptan | 16.4 weight parts |

After completing addition of the mixed monomer solution, the resulting reaction mixture was heated with stirring at 75° C. for 2 hours to undergo polymerization (first step polymerization) to obtain a first resin particle dispersion. The resin particles in the resulting first resin particle dispersion were designated as Resin Particles A1. The weight average molecular weight of the Resin Particles A1 prepared in the first step polymerization was 16,500.

(b) Second Step Polymerization

A mixed monomer solution comprised of the following compounds was introduced into a flask fitted with a stirrer. Successively, 93.8 weight parts of paraffin wax HNP-57 (produced Nippon Seiro Co., Ltd.) as a releasing agent was added thereto and dissolved with heating at 90° C. to prepare a paraffin wax-containing monomer solution.

| | |
|---|---|
| Styrene | 101.1 weight parts |
| n-Butyl acrylate | 62.2 weight parts |
| Methacrylic acid | 12.3 weight parts |
| n-Octyl mercaptan | 1.75 weight parts |

An aqueous surfactant solution was prepared by dissolving 3 weight parts of the above anionic surfactant in 1560 weight parts of deionized water and heated at 98° C. The above-obtained Resin Particles A1 in an amount of 32.8 weight parts (in terms of solid) was added to the aqueous surfactant solution prepared above, further added with the paraffin wax-containing monomer solution prepared above, and dispersed for 8 hours in a mechanical stirrer having a circulation path, CLEARMIX (produced by M Technique Co.). Thus, an emulsified particle dispersion containing emulsified particles having a dispersion particle size of 340 nm was prepared.

Subsequently, a polymerization initiator solution in which 6 weight parts of potassium persulfate were dissolved in 200 weight parts of deionized water was added to the emulsified particle dispersion obtained above. The resulting mixture was heated at 98° C. for 12 hours to undergo polymerization (second step polymerization) to prepare a second resin particle dispersion. The resin particles in the resulting second resin particle dispersion were designated as Resin Particles A2. The weight average molecular weight of the Resin Particles A2 prepared in the second step polymerization was 23,000.

(c) Third Step Polymerization

A polymerization initiator solution, in which 5.45 weight parts of potassium persulfate were dissolved in 220 weight parts of deionized water, was added to the second resin particle dispersion obtained above in the second step polymerization and was dropwise added with a monomer mixture solution comprised of the following compounds at a temperature of 80° C. in one hour.

| | |
|---|---|
| Styrene | 293.8 weight parts |
| n-Butyl acrylate | 154.1 weight parts |
| n-Octyl mercaptan | 7.08 weight parts |

After completing addition, the reaction mixture was heated with stirring for additional two 2 hours to undergo polymerization (third step polymerization). After completion of polymerization, the resulting mixture was cooled to 28° C. to obtain a third resin particle dispersion. The resin particles in the resulting third resin particle dispersion were designated as Core Resin Particles 1. The weight average molecular weight of the Core Resin Particles 1 in the third resin particle dispersion prepared in the third step polymerization was 26,800.

(3) Preparation of Shell Resin Particles 1

A shell resin particle dispersion was prepared in the same manner as in the first step polymerization above, except that the mixed monomer solution used in the first step polymerization was changed to the following mixed monomer solution. The resin particles in the resulting shell resin particle dispersion were designated as Shell Resin Particles 1.

| | |
|---|---|
| Styrene | 624 weight parts |
| 2-Ethylhexyl acrylate | 120 weight parts |
| Methacrylic acid | 56 weight parts |
| n-Octyl mercaptan | 16.4 weight parts |

(4) Preparation of Magenta Toner

Inventive Magenta Toners 10 through 18 and Comparative Magenta Toners 7 through 12 were prepared according to the following procedures.

(a) Formation of Core

The following composition was introduced into a reaction vessel fitted with a stirrer, a temperature sensor, a condenser and a nitrogen gas introducing device and stirred.

| | |
|---|---|
| Core Resin Particles 1 | 420.7 weight parts (in terms of solid) |
| Deionized water | 900 weight parts |
| Colorant Particle Dispersion (as shown in Table 3-1) | 200 weight parts |

The resulting mixture was adjusted to 30° C. and added with an aqueous 5 mol/L sodium hydroxide solution to give a pH of 8 to 11.

Subsequently, an aqueous solution in which 2 weight parts of magnesium chloride hexahydrate were dissolved in 1000 weight parts of deionized water was added thereto at 30° C. in 10 minutes. After allowed to stand for 3 minutes, the mixture was heated to 65° C. in 60 minutes to perform coagulation of particles. Using Multisizer 3 (produced by Beckman Coulter Co.), the particle size of the coagulated particles in the mixture was measured, and when the coagulated particles reached a volume based median size of 5.5 μm, the mixture was added with an aqueous solution in which 40.2 weight parts of sodium chloride were dissolved in 1000 weight parts of deionized water to terminate coagulation.

After terminating coagulation, ripening was conducted at 70° C. for one hour to allow fusion to continue, whereby a core dispersion was prepared. The core particles in the core dispersion were designated as Core 1.

The average circularity of the Core 1 in the core dispersion was 0.912, measured by FPIA 2100 (produced by SISMECS Co. Ltd.).

(b) Formation of Shell

Subsequently, 96 weight parts (in terms of solid) of Shell Resin Particles 1 were added to the above-obtained core dispersion maintained at 65° C., and an aqueous solution, in which 2 weight parts of magnesium chloride hexahydrate were dissolved in 1000 weight parts of deionized water, was further added thereto in 10 minutes. The resulting mixture was heated to 70° C. and stirred for 1 hour so that the Shell Resin Particles 1 was fusion-adhered onto the surface of the Core 1, and subjected to ripening processing at 75° C. for 20 minutes to form a shell.

Thereafter an aqueous solution in which 40.2 weight parts of sodium chloride were dissolved in 1000 weight parts was added to the mixture to terminate shell formation. The resulting mixture was cooled to 30° C. at a cooling rate of 8° C./minute, and filtered off to obtain colored particles. The colored particles were repeatedly washed with 45° C. deionized water, and dried with a 40° C. hot air. Thus, Colored Particles 10 through 18 and Comparative Colored Particles 7 through 12, each having a shell on the core surface, were prepared.

(c) External Addition Treatment

Subsequently, each of the Colored Particles 10 through 18 and Comparative Colored Particles 7 through 12 were added with the following external additives and subjected to external addition treatment with stirring in a HENSCHEL MIXER (produced by Mitsui-Miike Kogyo Co., Ltd.) to prepare Inventive Magenta Toners 10 through 18 and Comparative Magenta Toners 7 through 12, respectively.

| | |
|---|---|
| Hexamethylsilazane-treated silica (average primary particle size of 12 nm) | 0.6% by weight |
| n-Octylsilane-treated titanium oxide (average primary particle size of 24 nm) | 0.8% by weight |

The external treatment in a HENSCHEL MIXER was conducted at 35° C. for 15 minutes under condition of a stirring blade circumferential speed of 35 m/second.

The colorant particle dispersion used in each of the toners obtained above is shown in Table 3-1. The number average primary particle size, the major axis direction length, the minor axis direction length and the ratio of the major axis direction length to the minor axis direction length of the quinacridone pigment dispersed in each toner and the number average primary particle size of Pigment Red 238 dispersed in each toner are collectively shown in Table 3-2.

TABLE 3-2

| Magenta Toner | Colorant Particle Dispersion No. | Quinacridone Pigment | | | | | Pigment Red 238 |
|---|---|---|---|---|---|---|---|
| No. | used | No. | (a) | (b) | (c) | (d) | (a) |
| 10 (Inv.) | 2 | 2 | 47 | 50 | 39 | 1.28 | 100 |
| 11 (Inv.) | 3 | 3 | 55 | 66 | 42 | 1.57 | 100 |
| 12 (Inv.) | 4 | 4 | 76 | 90 | 62 | 1.48 | 100 |
| 13 (Inv.) | 5 | 5 | 88 | 90 | 88 | 1.02 | 100 |
| 14 (Inv.) | 6 | 6 | 89 | 120 | 76 | 1.58 | 100 |
| 15 (Inv.) | 7 | 7 | 97 | 120 | 113 | 1.06 | 100 |
| 16 (Inv.) | 8 | 8 | 119 | 151 | 92 | 1.64 | 60 |
| 17 (Inv.) | 9 | 9 | 121 | 176 | 93 | 1.89 | 90 |
| 18 (Inv.) | 10 | 10 | 145 | 178 | 93 | 1.91 | 120 |
| 7 (Comp.) | 1 | 1 | 22 | 27 | 18 | 1.50 | 120 |
| 8 (Comp.) | 11 | 11 | 160 | 174 | 139 | 1.25 | 120 |
| 9 (Comp.) | 12 | 12 | 88 | 144 | 58 | 2.48 | 120 |
| 10 (Comp.) | 13 | 13 | 167 | 253 | 110 | 2.30 | 120 |
| 11 (Comp.) | 14 | 6 | 89 | 120 | 76 | 1.58 | — |
| 12 (Comp.) | 15 | None | — | — | — | — | 100 |

Inv.: Inventive,

Comp.: Comparative (a) Number Average Primary Particle Size (nm)

(b) Major Axis Direction Length (nm)

(c) Minor Axis Direction Length (nm)

(d) Ratio of Major Axis Direction Length to Minor Axis Direction Length

Preparation of Another Color Toner (Preparation of Yellow Toner 1)

Yellow Toner 1 was prepared in the same manner as Inventive Magenta Toner 5 above, except that C.I. Pigment Yellow 74 was used instead of Quinacridone Pigment 6.

(Preparation of Yellow Toner 2)

Yellow Toner 2 was prepared in the same manner as Inventive Magenta Toner 13 above, except that C.I. Pigment Yellow 74 was used instead of Quinacridone Pigment 5.

(Preparation of Cyan Toner 1)

Cyan Toner 1 was prepared in the same manner as Inventive Magenta Toner 5 above, except that C.I. Pigment Blue 15:3 was used instead of Quinacridone Pigment 6.

(Preparation of Cyan Toner 2)

Cyan Toner 2 was prepared in the same manner as Inventive Magenta Toner 13 above, except that C.I. Pigment Blue 15:3 was used instead of Quinacridone Pigment 5.

(Preparation of Black Toner 1)

Black Toner 1 was prepared in the same manner as Inventive Magenta Toner 5 above, except that carbon black MOGUL L was used instead of Quinacridone Pigment 6.

(Preparation of Black Toner 2)

Black Toner 2 was prepared in the same manner as Inventive Magenta Toner 13 above, except that carbon black MOGUL L was used instead of Quinacridone Pigment 5.

(Preparation of Developers)

Each of Inventive Magenta Toners 1 through 18 and Comparative Magenta Toners 1 through 12, Yellow Toners 1 and 2, Cyan Toners 1 and 2, and Black Toners 1 and 2 was mixed with ferrite carrier covered with methyl methacrylate-cyclohexyl methacrylate copolymer resin having a volume based median size of 50 μm to prepare Inventive Magenta Developers 1 through 18, Comparative Magenta Developers 1 through 12, Yellow Developers 1 and 2, Cyan Developers 1 and 2, and Black Developers 1 and 2, respectively. Each developer had a toner content of 6%.

2. Evaluation

Evaluation was conducted using a commercially available, multi-functional printer, bizhub Pro C500 (produced by Konica Minolta Business Technology Inc.) corresponding to an image formation apparatus of a two-component development system, as illustrated in FIG. 1, in which each of the four developing devices was charged with each of the developers.

A combination of the developers is as shown in Table 4.

Examples 1 through 18 employ Inventive Magenta Developers 1 through 18, respectively, and Comparative Examples 1 through 12 employ Comparative Magenta Developers 1 through 12, respectively.

TABLE 4

| | Combination of Developers | | | |
|---|---|---|---|---|
| | Magenta Developer No. | Cyan Developer No. | Yellow Developer No. | Black Developer No. |
| Ex.*1) 1 | 1 (Inventive) | 1 | 1 | 1 |
| Ex. 2 | 2 (Inventive) | 1 | 1 | 1 |
| Ex. 3 | 3 (Inventive) | 1 | 1 | 1 |
| Ex. 4 | 4 (Inventive) | 1 | 1 | 1 |
| Ex. 5 | 5 (Inventive) | 1 | 1 | 1 |
| Ex. 6 | 6 (Inventive) | 1 | 1 | 1 |
| Ex. 7 | 7 (Inventive) | 1 | 1 | 1 |
| Ex. 8 | 8 (Inventive) | 1 | 1 | 1 |
| Ex. 9 | 9 (Inventive) | 1 | 1 | 1 |
| Ex. 10 | 10 (Inventive) | 2 | 2 | 2 |
| Ex. 11 | 11 (Inventive) | 2 | 2 | 2 |
| Ex. 12 | 12 (Inventive) | 2 | 2 | 2 |
| Ex. 13 | 13 (Inventive) | 2 | 2 | 2 |
| Ex. 14 | 14 (Inventive) | 2 | 2 | 2 |
| Ex. 15 | 15 (Inventive) | 2 | 2 | 2 |
| Ex. 16 | 16 (Inventive) | 2 | 2 | 2 |
| Ex. 17 | 17 (Inventive) | 2 | 2 | 2 |
| Ex. 18 | 18 (Inventive) | 2 | 2 | 2 |
| Comp. Ex.*2) 1 | 1 (Comparative) | 1 | 1 | 1 |
| Comp. Ex. 2 | 2 (Comparative) | 1 | 1 | 1 |
| Comp. Ex. 3 | 3 (Comparative) | 1 | 1 | 1 |
| Comp. Ex. 4 | 4 (Comparative) | 1 | 1 | 1 |
| Comp. Ex. 5 | 5 (Comparative) | 1 | 1 | 1 |
| Comp. Ex. 6 | 6 (Comparative) | 1 | 1 | 1 |
| Comp. Ex. 7 | 7 (Comparative) | 2 | 2 | 2 |
| Comp. Ex. 8 | 8 (Comparative) | 2 | 2 | 2 |
| Comp. Ex. 9 | 9 (Comparative) | 2 | 2 | 2 |
| Comp. Ex. 10 | 10 (Comparative) | 2 | 2 | 2 |
| Comp. Ex. 11 | 11 (Comparative) | 2 | 2 | 2 |
| Comp. Ex. 12 | 12 (Comparative) | 2 | 2 | 2 |

Ex.*1): Example,
Comp. Ex.*2): Comparative Example (Evaluation of Color Reproduction Region of Full Color Image)

Employing the developers obtained above, a 2 cm×2 cm solid image of each of a monochromatic yellow (Y) color, a monochromatic magenta (M) color, a monochromatic cyan (C) color, a monochromatic red (R) color, a monochromatic blue (B) color and a monochromatic green (G) color was formed at 20° C. and at 50% RH. The color gamut thereof was represented on the a*-b* coordinate, and the area (color gamut area) thereof was determined. Color reproduction region of each developer was represented in terms of a value relative to an area composed of color gamut of Y/M/C/R/G/B of Comparative developer 3 being set at 100, and was evaluated. The difference between a solid image having a color gamut area of not less than 115 and a solid image on a computer display is greatly reduced.

(Light Resistance)

A magenta image with a size of 10 cm×10 cm was formed employing Inventive Magenta Developers 1 through 18 and Comparative Developers 1 through 12. The resulting magenta image was subjected to exposure of 70,000 lux for 480 hours employing a xenon weather meter XL75. The image reflection densities before and after exposure were measured. Then, the reflection density variation (%) between before and after exposure was determined, and evaluated as a measure of light resistance.

Herein, the reflection density variation (%) before and after exposure is represented by the following formula:

Reflection density variation(%)between before and after exposure=(Reflection density before exposure−Reflection density after exposure)×100/Reflection density before exposure The results are shown in Table 5.

TABLE 5

| | Evaluation Results | |
|---|---|---|
| | Color Gamut | Reflection Density Variation Between Before And After Exposure (%) |
| Ex.*1) 1 | 122 | 1.2 |
| Ex. 2 | 123 | 0.6 |

TABLE 5-continued

| | Evaluation Results | |
|---|---|---|
| | Color Gamut | Reflection Density Variation Between Before And After Exposure (%) |
| Ex. 3 | 125 | 0.8 |
| Ex. 4 | 125 | 0.5 |
| Ex. 5 | 123 | 0.0 |
| Ex. 6 | 121 | 0.1 |
| Ex. 7 | 122 | 0.0 |
| Ex. 8 | 121 | 0.1 |
| Ex. 9 | 122 | 0.1 |
| Ex. 10 | 123 | 1.3 |
| Ex. 11 | 124 | 0.7 |
| Ex. 12 | 121 | 0.5 |
| Ex. 13 | 120 | 0.4 |
| Ex. 14 | 121 | 0.0 |
| Ex. 15 | 122 | 0.1 |
| Ex. 16 | 121 | 0.0 |
| Ex. 17 | 121 | 0.1 |
| Ex. 18 | 121 | 0.1 |
| Comp. Ex.*2) 1 | 118 | 9.1 |
| Comp. Ex. 2 | 115 | 0.2 |
| Comp. Ex. 3 | 100 | 0.4 |
| Comp. Ex. 4 | 102 | 0.3 |
| Comp. Ex. 5 | 119 | 9.0 |
| Comp. Ex. 6 | 100 | 0.9 |
| Comp. Ex. 7 | 118 | 9.1 |
| Comp. Ex. 8 | 115 | 0.2 |
| Comp. Ex. 9 | 100 | 0.4 |
| Comp. Ex. 10 | 102 | 0.3 |
| Comp. Ex. 11 | 119 | 9.0 |
| Comp. Ex. 12 | 100 | 0.9 |

Ex.*1): Example,
Comp. Ex.*2): Comparative Example

As is apparent from Table 5, Examples 1 through 18 employing Inventive Magenta Developers 1 through 18 containing the inventive magenta toner provide increased color gamut area, as compared with Comparative Examples 1 through 12 employing Comparative Magenta Developers 1 through 12 containing the comparative magenta toner. Thus, use of Inventive Magenta Developers 1 through 18 containing the inventive magenta toner can increase color gamut area.

It has proved that an image formed employing Inventive Magenta Developers 1 through 18 containing the inventive magenta toner has excellent light resistance, as compared with that formed employing Comparative Magenta Developers 1 through 8 containing the comparative magenta toner.

What is claimed is:

1. A toner for developing an electrostatic image, the toner containing at least a resin and a colorant, wherein the colorant comprises a quinacridone pigment having a number average primary particle size of from 30 to 150 nm and having a ratio of a major axis direction length to a minor axis direction length of from 1.0 to 2.0 and Pigment Red 238.

2. The toner for developing an electrostatic image of claim 1, wherein the quinacridone pigment is a dimethylquinacridone pigment, a dichloroquinacridone pigment or an unsubstituted quinacridone pigment.

3. The toner for developing an electrostatic image of claim 2, wherein the quinacridone pigment is a dimethylquinacridone pigment.

4. The toner for developing an electrostatic image of claim 3, wherein the dimethylquinacridone pigment is C.I. Pigment Red 122.

5. The toner for developing an electrostatic image of claim 4, wherein the C.I. Pigment Red 122 has a number average primary particle size of from 50 to 100 nm and a specific surface area of from 85 to 95 $m^2/g$.

6. The toner for developing an electrostatic image of claim 1, wherein the Pigment Red 238 has a number average primary particle size of from 10 to 200 nm.

7. The toner for developing an electrostatic image of claim 1, wherein the total content of the quinacridone pigment and Pigment Red 238 in the toner is from 1 to 10% by weight.

8. The toner for developing an electrostatic image of claim 7, wherein the content ratio (by weight) of the quinacridone pigment to the Pigment Red 238 in the toner is from 10:90 to 90:10.

9. The toner for developing an electrostatic image of claim 8, wherein the content ratio (by weight) of the quinacridone pigment to the Pigment Red 238 in the toner is from 30:70 to 70:30.

10. The toner for developing an electrostatic image of claim 1, wherein the resin is a polymer having in the side chain a carboxyl group, a sulfonic acid group or a phosphoric acid group.

11. The toner for developing an electrostatic image of claim 1, wherein the content of the resin in the toner is from 65 to 98% by weight.

12. The toner for developing an electrostatic image of claim 1, wherein the toner has a volume based median size of from 3 to 8 μm.

13. The toner for developing an electrostatic image of claim 1, wherein the toner has a coefficient of variation of from 2 to 21% in the volume based particle size distribution.

14. The toner for developing an electrostatic image of claim 1, wherein the toner has a softening point (Tsp) of from 70 to 110° C.

15. A full color toner kit comprised of at least four kinds of toners, the four kinds of toners comprising a yellow toner containing at least a yellow colorant and a resin, a magenta toner containing at least a magenta colorant and a resin, a cyan toner containing at least a cyan colorant and a resin, and a black toner containing at least a black colorant and a resin, wherein the magenta colorant comprises a quinacridone pigment having a number average primary particle size of from 30 to 150 nm and having a ratio of a major axis direction length to a minor axis direction length of from 1.0 to 2.0 and Pigment Red 238.

16. An image formation method comprising the step of:

developing an electrostatic image employing at least four kinds of toners to form an image, the four kinds of toners comprising a yellow toner containing at least a yellow colorant and a resin, a magenta toner containing at least a magenta colorant and a resin, a cyan toner containing at least a cyan colorant and a resin, and a black toner containing at least a black colorant and a resin, wherein the magenta colorant comprises a quinacridone pigment having a number average primary particle size of from 30 to 150 nm and having a ratio of a major axis direction length to a minor axis direction length of from 1.0 to 2.0 and Pigment Red 238.

* * * * *